US009163622B2

(12) United States Patent
Sata et al.

(10) Patent No.: US 9,163,622 B2
(45) Date of Patent: Oct. 20, 2015

(54) DISCHARGE MUFFLER AND TWO-STAGE COMPRESSOR INCLUDING THE SAME

(75) Inventors: Kenichi Sata, Osaka (JP); Shuuji Fujimoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 85 days.

(21) Appl. No.: 13/259,395

(22) PCT Filed: Mar. 24, 2010

(86) PCT No.: PCT/JP2010/002059

§ 371 (c)(1),
(2), (4) Date: Oct. 5, 2011

(87) PCT Pub. No.: WO2010/109852

PCT Pub. Date: Sep. 30, 2010

(65) Prior Publication Data

US 2012/0011876 A1 Jan. 19, 2012

(30) Foreign Application Priority Data

Mar. 25, 2009 (JP) ..... 2009-074423

(51) Int. Cl.
*F25D 19/00* (2006.01)
*F04B 39/00* (2006.01)
(Continued)

(52) U.S. Cl.
CPC ..... *F04B 39/0038* (2013.01); *F04B 39/0061* (2013.01); *F04B 39/023* (2013.01); *F04B 39/04* (2013.01); *F04C 23/008* (2013.01); *F04C 29/026* (2013.01); *F04C 29/065* (2013.01); *F04C 18/356* (2013.01); *F04C 23/001* (2013.01); *F24F 13/24* (2013.01); *F25B 31/002* (2013.01);
(Continued)

(58) Field of Classification Search
CPC .. F25B 2500/12; F25B 43/02; F25B 2500/16; F25B 31/002; F24F 13/24; F24F 2013/24; F24F 2001/0053
USPC ..... 62/296, 84, 83, 192–193, 468, 470, 62/503; 417/312; 181/249, 255
See application file for complete search history.

(56) References Cited

U.S. PATENT DOCUMENTS 5,784,784 A * 7/1998 Flanigan et al. ..... 29/890.08
6,446,454 B1 * 9/2002 Lee et al. ..... 62/296
(Continued)

FOREIGN PATENT DOCUMENTS

JP 6-147175 A 5/1994
JP 2003-166472 A 6/2003
JP 2008-175066 A 7/2008

OTHER PUBLICATIONS

Antony Barber, Section 2—The Compressor, Pneumatic Handbook (Eight Edition), Butterworth-Heinemann, Oxford, 1997, p. 53, ISBN 9781856172493, 10.1016/B978-185617249-3/50003-9. (http://www.sciencedirect.com/science/article/pii/B9781856172493500039).*
(Continued)

*Primary Examiner* — Frantz Jules
*Assistant Examiner* — Steve Tanenbaum
(74) *Attorney, Agent, or Firm* — Birch, Stewart, Kolasch & Birch, LLP

(57) ABSTRACT

A discharge muffler includes a muffler container. In the muffler container, refrigerating machine oil is separated from refrigerant gas containing the refrigerating machine oil, and the refrigerating machine oil is stored in a lower space. An inlet of an outlet pipe connected to the muffler container opens in the lower space.

4 Claims, 4 Drawing Sheets

(51) Int. Cl.

| | |
|---|---|
| ***F01N 1/02*** | (2006.01) |
| ***F01N 1/00*** | (2006.01) |
| ***F25B 43/00*** | (2006.01) |
| ***F25B 43/02*** | (2006.01) |
| ***F25B 31/00*** | (2006.01) |
| ***F04B 39/02*** | (2006.01) |
| ***F04B 39/04*** | (2006.01) |
| ***F04C 29/02*** | (2006.01) |
| ***F04C 29/06*** | (2006.01) |
| *F24F 13/24* | (2006.01) |
| *F04C 18/356* | (2006.01) |
| *F04C 23/00* | (2006.01) |

(52) U.S. Cl.

CPC ..... *F25B43/02* (2013.01); *F25B 2500/12* (2013.01); *F25B 2500/16* (2013.01)

(56) References Cited

U.S. PATENT DOCUMENTS

| | | | | |
|---|---|---|---|---|
| 6,692,238 | B2 * | 2/2004 | Myung et al. | 417/312 |
| 2004/0165999 | A1 * | 8/2004 | Tadano et al. | 417/312 |
| 2006/0045762 | A1 * | 3/2006 | Lee | 417/312 |
| 2007/0251264 | A1 * | 11/2007 | Jang et al. | 62/470 |
| 2008/0078191 | A1 * | 4/2008 | Morishita et al. | 62/126 |

OTHER PUBLICATIONS

Antony Barber, Section 2—The Compressor, Pneumatic Handbook (Eight Edition), Butterworth-Heinemann, Oxford, 1997, p. 53, ISBN 9781856172493, 10.1016/B978-185617249-3/50003-9. (http://www.sciencedirect.com/science/article/pii/B9781856172493500039).*

* cited by examiner

DISCHARGE MUFFLER AND TWO-STAGE COMPRESSOR INCLUDING THE SAME

TECHNICAL FIELD

The present invention relates to a discharge muffler for reducing noise of refrigerant gas discharged from a compressor, and a two-stage compressor including the discharge muffler.

BACKGROUND ART

Conventionally, a discharge muffler has been known, which cancels noise of refrigerant gas discharged from a compressor and containing refrigerating machine oil. As described in Patent Document 1, as the discharge muffler of this type, there is a discharge muffler including an oil return pipe for discharging refrigerating machine oil accumulated in the discharge muffler.

The discharge muffler is provided on an outlet side of a high-pressure compression mechanism in an intermediate-pressure dome type two-stage compressor (i.e., a two-stage compressor in which an inside of a casing of the compressor is under a discharge pressure of a low-pressure compression mechanism). The discharge muffler includes an elongated cylindrical volume portion (muffler container) which is closed at upper and lower ends, and a supply pipe (inlet path), a discharge pipe (outlet path), and the oil return pipe are connected to the volume portion.

An inlet end of the supply pipe is connected to the outlet side of the high-pressure compression mechanism, and an outlet end of the supply pipe is positioned in an upper space inside the volume portion with the supply pipe penetrating an upper surface of the volume portion. An inlet end of the discharge pipe is positioned in a lower space inside the volume portion, and an outlet end of the discharge pipe is positioned outside the volume portion with the discharge pipe penetrating the upper surface of the volume portion. An inlet end of the oil return pipe is connected to an opening provided in a bottom surface of the volume portion, and an outlet end of the oil return pipe is connected to an opening provided in the casing of the two-stage compressor.

In the discharge muffler, refrigerant gas discharged from the high-pressure compression mechanism and containing refrigerating machine oil flows into the upper space inside the volume portion through the supply pipe. The refrigerant gas flowing into the upper space flows toward the lower space inside the volume portion while turning along an inner circumferential surface of the volume portion. While the refrigerant gas flows toward the lower space, noise of the refrigerant gas is canceled, and the refrigerating machine oil contained in the refrigerant gas is separated from the refrigerant gas by centrifugal force caused due to the turning of the refrigerant gas. Then, the refrigerant gas from which the refrigerating machine oil is separated flows out from the volume portion through the discharge pipe. The refrigerating machine oil separated from the refrigerant gas is temporarily stored in the lower space, and then is discharged to the casing of the two-stage compressor through the oil return pipe.

CITATION LIST

Patent Document

PATENT DOCUMENT 1: Japanese Patent Publication No. 2008-175066

SUMMARY OF THE INVENTION

Technical Problem

However, e.g., under an operating condition under which a difference between a suction pressure and a discharge pressure is small in the two-stage compressor, a difference between a pressure in the discharge muffler and a pressure in the casing of the two-stage compressor is decreased. Thus, there is a problem that it is less likely to discharge the refrigerating machine oil accumulated in the discharge muffler through the oil return pipe.

The present invention has been made in view of the foregoing, and it is an objective of the present invention to, in a discharge muffler for canceling noise of refrigerant gas discharged from a compressor and containing refrigerating machine oil, reduce accumulation of the refrigerating machine oil in the discharge muffler.

Solution to the Problem

A first aspect of the invention is intended for a discharge muffler including a muffler container (2); an inlet path (8) through which refrigerant gas discharged from a compressor (10) and containing refrigerating machine oil flows into the muffler container (2); and an outlet path (7) through which the refrigerant gas flows out from the muffler container (2).

In the muffler container (2), the refrigerating machine oil is separated from the refrigerant gas containing the refrigerating machine oil, and the refrigerating machine oil separated from the refrigerant gas is stored in a lower space (2*b*) of the muffler container (2). An inlet (7*c*) of the outlet path (7) opens in the lower space (2*b*).

In the first aspect of the invention, when refrigerant gas discharged from the compressor (10) and containing refrigerating machine oil flows into the muffler container (2) through the inlet pipe (8), noise of the refrigerant gas is canceled in the muffler container (2) while part of the refrigerating machine oil is separated from the refrigerant gas. The separated refrigerating machine oil is stored in the lower space (2*b*) of the muffler container (2), and the refrigerant gas from which the part of refrigerating machine oil is separated flows out from the muffler container (2) through the outlet path (7).

When a flow velocity of the refrigerant gas containing the refrigerating machine oil is high, the separated refrigerating machine oil is blown up by the refrigerant gas in the muffler container (2), and is re-changed into mist. Then, the refrigerating machine oil flows out from the muffler container (2). Under such a condition, an amount of the refrigerating machine oil stored in the lower space (2*b*) of the muffler container (2) does not increase.

On the other hand, when the flow velocity of the refrigerant gas containing the refrigerating machine oil is low, an outflow of the refrigerating machine oil is decreased due to the re-change of the refrigerating machine oil into mist. Thus, when the refrigerant gas containing the refrigerating machine oil continues to flow into the muffler container (2) through the inlet path (8), an amount of the refrigerating machine oil stored in the lower space (2*b*) is increased, and a surface level of the refrigerating machine oil rises. When the surface level of the refrigerating machine oil becomes higher than the inlet (7*c*) of the outlet path (7), the refrigerating machine oil flows into the outlet path (7) through the inlet (7*c*), and then flows out from the muffler container (2) through the outlet path (7).

Subsequently, when the refrigerating machine oil flows out from the muffler container (2), and the surface level of the refrigerating machine oil becomes lower than the inlet (7*c*) of the outlet path (7), the refrigerant gas in the muffler container (2) re-flows into the outlet path (7) through the inlet (7*c*), and then flows out from the muffler container (2) through the outlet path (7).

In such a manner, the inlet (7*c*) of the outlet path (7), which opens in the lower space (2*b*) allows not only the refrigerant gas but also the refrigerating machine oil accumulated in the lower space (2*b*) to be discharged through the outlet path (7).

A second aspect of the invention is intended for the discharge muffler of the first aspect of the invention, in which the inlet (7*c*) of the outlet path (7) and an outlet (8*a*) of the inlet path (8) are arranged in positions which do not face each other.

In the second aspect of the invention, the inlet (7*c*) of the outlet path (7) and the outlet (8*a*) of the inlet path (8) are arranged in the positions which do not face each other. This reduces quick flowing of refrigerant gas flowing into the muffler container (2) through the outlet (8*a*) of the inlet path (8) into the inlet (7*c*) of the outlet path (7), which results in blocking discharge of the refrigerating machine oil stored in a lower portion of the discharge muffler.

A third aspect of the invention is intended for the discharge muffler of the first or second aspect of the invention, in which the inlet (7*c*) of the outlet path (7) is arranged lower than the outlet (8*a*) of the outlet path (8).

In the third aspect of the invention, the inlet (7*c*) of the outlet path (7) is arranged lower than the outlet (8*a*) of the outlet path (8), and therefore a rise in surface level of the refrigerating machine oil accumulated in the lower space (2*b*) beyond the outlet (8*a*) of the inlet path (8) can be reduced. Thus, it is less likely that the outlet (8*a*) of the inlet path (8) is immersed in the refrigerating machine oil accumulated in the lower space (2*b*).

A fourth aspect of the invention is intended for a two-stage compressor including a compression mechanism (13) in which a low-pressure compression chamber (32) and a high-pressure compression chamber (33) are formed, and a casing (12) in which the compression mechanism (13) is accommodated. In the two-stage compressor, an outlet port of the high-pressure compression chamber (33) opens in the casing (12), and refrigerant compressed in the low-pressure compression chamber (32) is further compressed in the high-pressure compression chamber (33).

In addition, in the fourth aspect of the invention, the two-stage compressor includes the discharge muffler (1) of any one of claims 1-3. An inlet of the inlet path (8) of the discharge muffler (1) is connected to an outlet port of the low-pressure compression chamber (32), and an outlet of the outlet path (7) of the discharge muffler (1) is connected to an inlet port of the high-pressure compression chamber (33).

In the fourth aspect of the invention, the discharge muffler of the present invention is arranged on an outlet side of the low-pressure compression chamber (32) of the two-stage compressor (10). Thus, noise of refrigerant discharged from the low-pressure compression chamber (32) and containing refrigerating machine oil can be canceled while refrigerating machine oil accumulated in the muffler container (2) of the discharge muffler (1) is discharged. The refrigerant and the refrigerating machine oil flowing out from the muffler container (2) are discharged from the outlet port of the high-pressure compression chamber (33) to the casing (12) through the high-pressure compression chamber (33).

Advantages of the Invention

According to the present invention, the inlet (7*c*) of the outlet path (7) opens in the lower space (2*b*), and therefore not only refrigerant gas but also refrigerating machine oil accumulated in the lower space (2*b*) can be discharged through the outlet path (7). Unlike the prior art, the refrigerating machine oil can be discharged to outside the muffler container (2) without using an oil return pipe. As a result, it is less likely that the refrigerating machine oil is accumulated in the discharge muffler.

According to the second aspect of the invention, the quick flowing of refrigerant gas flowing into the muffler container (2) through the outlet (8*a*) of the inlet path (8) and containing refrigerating machine oil into the inlet (7*c*) of the outlet path (7) can be reduced. Consequently, a function to cancel noise of refrigerant gas passing through the discharge muffler and containing refrigerating machine oil and a function to discharge the separated refrigerating machine oil are not degraded.

According to the third aspect of the invention, it is less likely that the outlet (8*a*) of the inlet path (8) is immersed in refrigerating machine oil accumulated in the lower space (2*b*), and refrigerant gas containing the refrigerating machine oil can smoothly flow into the muffler container (2) through the outlet (8*a*) of the inlet path (8).

According to the fourth aspect of the invention, the discharge muffler (1) of the present invention is arranged on the outlet side of the low-pressure compression chamber (32) of the two-stage compressor (10), and therefore refrigerating machine oil accumulated in the muffler container (2) of the discharge muffler (1) can be discharged from the muffler container (2). In addition, the refrigerating machine oil flowing out from the muffler container (2) can be returned to the casing (12) of the two-stage compressor (10) through the low-pressure compression chamber (32).

DESCRIPTION OF EMBODIMENTS

An embodiment of the present invention will be described below in detail with reference to the drawings. First, a discharge muffler of the embodiment of the present embodiment will be described. Subsequently, a two-stage compressor to which the discharge muffler is attached will be described, followed by description of a refrigerating apparatus to which the two-stage compressor is connected.

<Discharge Muffler>

Figure 1:
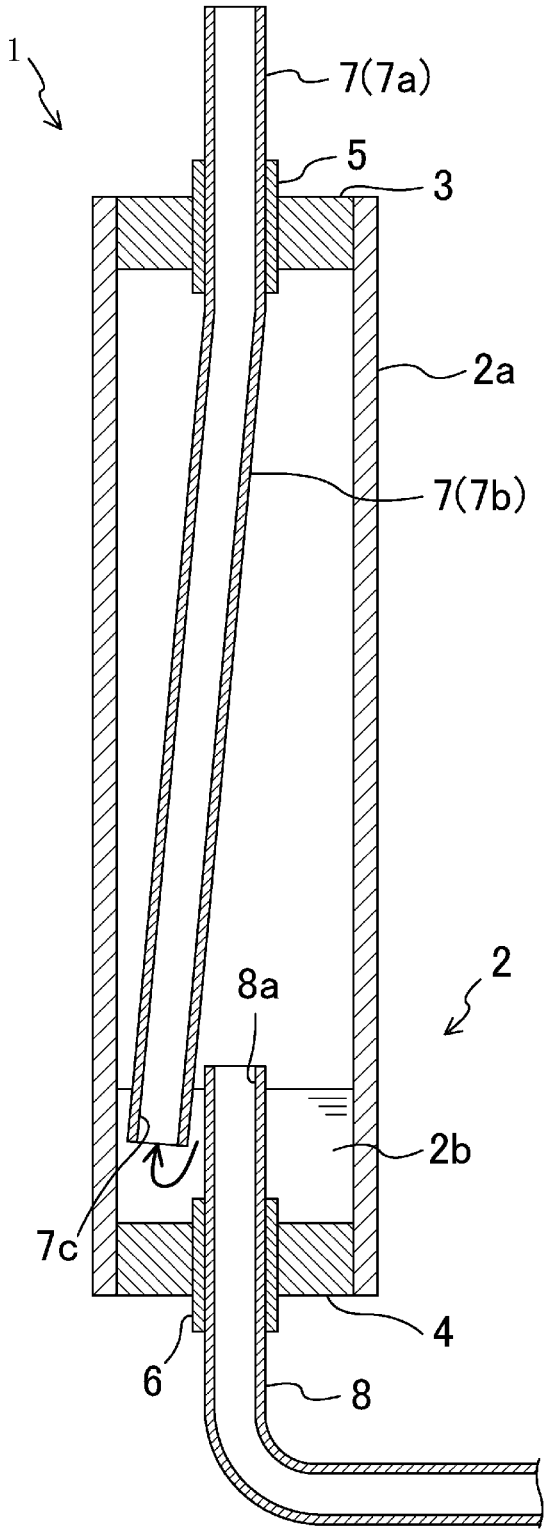
FIG. 1 is a longitudinal sectional view of a discharge muffler of an embodiment of the present invention.

FIG. 1 is a longitudinal sectional view illustrating a configuration of a discharge muffler (1). As illustrated in FIG. 1, the discharge muffler (1) includes a muffler container (2), an inlet pipe (inlet path) (8), and an outlet pipe (outlet path) (7).

In the muffler container (2), refrigerating machine oil is separated from refrigerant gas containing the refrigerating machine oil, and the refrigerating machine oil separated from the refrigerant gas is stored in a lower space (2*b*) of the muffler container (2).

The muffler container (2) includes a cylindrical body (2*a*), an upper closing plate (3) closing an upper end portion of the body (2*a*), and a lower closing plate (4) closing a lower end portion of the body (2*a*). A through-hole penetrating the upper closing plate (3) or the lower closing plate (4) in a thickness direction thereof is formed in each of the upper closing plate (3) and the lower closing plate (4). A short tubular pipe joint (5, 6) is fixed with the pipe joint (5, 6) being inserted into the through-hole. The outlet pipe (7) is fixed with the outlet pipe (7) being inserted into the pipe joint (5) of the upper closing plate (3), and the inlet pipe (8) is fixed with the inlet pipe (8) being inserted into the pipe joint (6) of the lower closing plate (4).

The outlet pipe (7) includes a straight pipe portion (7*a*) and a curved pipe portion (7*b*) continuing from the straight pipe portion (7*a*). A predetermined angle is formed by a pipe axis direction of the curved pipe portion (7*b*) and a pipe axis direction of the straight pipe portion (7*a*). The outlet pipe (7) is attached to the muffler container (2) so that the curved pipe portion (7*b*) is positioned inside the muffler container (2). Note that an upper end of the straight pipe portion (7*a*) is an outlet end of the outlet pipe (7), and the outlet end of the outlet pipe (7) opens outside the muffler container (2). In addition, a lower end of the curved pipe portion (7*b*) is an inlet end (inlet) (7*c*) of the outlet pipe (7), and the inlet end (7*c*) opens in the lower space (2*b*) of the muffler container (2).

The inlet pipe (8) is an elbow pipe curved 90 degrees. An inlet end of the inlet pipe (8) opens outside the muffler container (2), and an outlet end (outlet) (8*a*) of the inlet pipe (8) opens in the lower space (2*b*) of the muffler container (2).

As will be seen from FIG. 1, the inlet end (7*c*) of the outlet pipe (7) and the outlet end (8*a*) of the inlet pipe (8) are arranged in positions which do not face each other. In addition, the inlet end (7*c*) of the outlet pipe (7) is arranged lower than the outlet end (8*a*) of the inlet pipe (8).

<Two-Stage Compressor>

Figure 2:
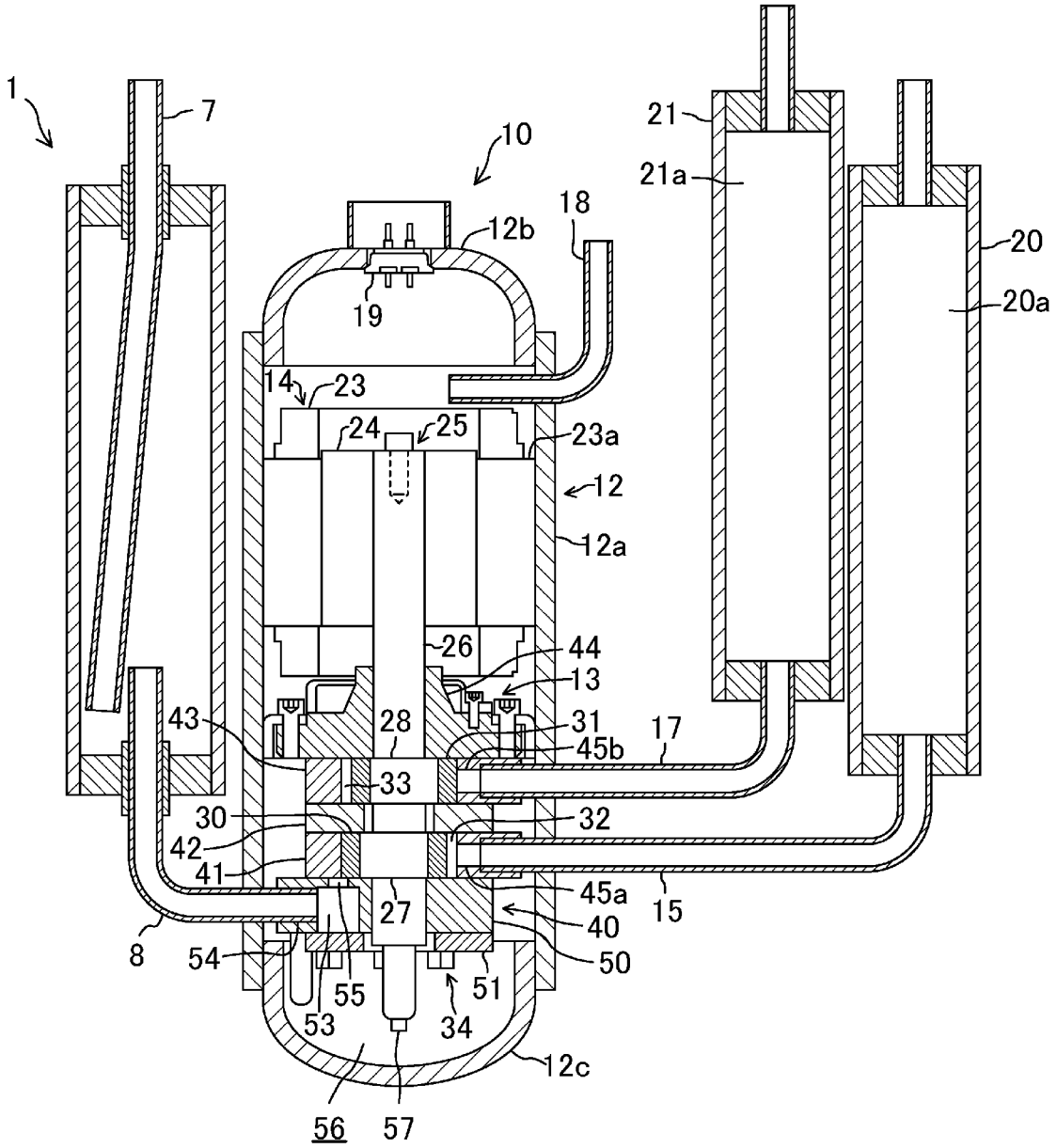
FIG. 2 is a longitudinal sectional view of a compressor of the embodiment of the present invention.

FIG. 2 is a longitudinal sectional view illustrating a configuration of a two-stage compressor (10). As illustrated in FIG. 2, the two-stage compressor (10) is a so-called "hermetic compressor" having a casing (12) in which a compression mechanism (13) and an electrical motor (14) are accommodated. In addition, the two-stage compressor (10) includes the discharge muffler (1), a first suction muffler (20), and a second suction muffler (21).

The casing (12) includes a cylindrical body portion (12*a*), an upper end plate (12*b*) fixed to an upper end portion of the body portion (12*a*), and a lower end plate (12*c*) fixed to a lower end portion of the body portion (12*a*). A low-pressure suction pipe (15), the inlet pipe (8) of the discharge muffler (1), and a high-pressure suction pipe (17) are attached so as to penetrate a lower portion of the body portion (12*a*). In addition, a discharge pipe (18) is attached so as to penetrate an upper portion of the body portion (12*a*). A terminal (19) is attached so as to penetrate a top portion of the upper end plate (12*b*). An inverter which is not shown in the figure is connected to the terminal (19) through electrical wires.

The inverter is configured to supply current to the two-stage compressor (10) through the electrical wires and to adjust a frequency of the current within a predetermined range. That is, an operating capacity of the two-stage compressor (10) can be freely changed within a certain range by the inverter.

The electrical motor (14) is arranged in an upper portion inside the casing (12), and includes a stator (23) and a rotor (24). The stator (23) is fixed to an inner circumferential surface of the body portion (12*a*) of the casing (12). Note that the stator (23) includes a cylindrical stator core (23*a*) and a three-phase wire wound around the stator core (23*a*). The wire and the terminal (19) are connected together through lead wires which are not shown in the figure. The rotor (24) is arranged inside the stator (23). A main shaft portion (26) of a vertically extending shaft (25) is connected to a center portion of the rotor (24).

In the main shaft portion (26) of the shaft (25), a first eccentric portion (27) and a second eccentric portion (28) are formed in order from bottom to top. The first eccentric portion (27) and the second eccentric portion (28) are formed so as to have a diameter larger than that of the main shaft portion (26) and to be eccentric relative to a center axis of the main shaft portion (26). In addition, the first eccentric portion (27) and the second eccentric portion (28) are formed so as to have the same eccentric amount and opposite eccentric directions relative to the center axis of the main shaft portion (26).

A main oil supply path (not shown in the figure) is formed along an axis direction inside the shaft (25). An oil supply pump (57) is provided in a lower end portion of the shaft (25), and draws refrigerating machine oil accumulated in a bottom portion (56) of the casing (12) by rotation of the shaft (25). The main oil supply path is formed so that the refrigerating machine oil drawn by the oil supply pump (57) is supplied to each of sliding portions of the compression mechanism (13).

The compression mechanism (13) includes a cylinder (34) in which a low-pressure compression chamber (32) and a high-pressure compression chamber (33) are formed in two tiers, and low-pressure and high-pressure pistons (30, 31). In the cylinder (34), a rear head (40), a low-pressure cylinder body (41), a middle plate (42), a high-pressure cylinder body (43), and a front head (44) are stacked in order from bottom to top. The cylinder bodies (41, 43) and the middle plate (42) are formed in an annular shape.

The shaft (25) penetrates the rear head (40), the front head (44), the cylinder bodies (41, 43), and the middle plate (42). In order to rotatably support the shaft (25) penetrating the foregoing components, bearing portions (not shown in the figure) are provided in center portions of the rear head (40) and the front head (44).

Although not shown in the figure, an annular body portion and a blade protruding from the body portion in a radial direction are integrally formed in each of the low-pressure and high-pressure pistons (30, 31).

The low-pressure piston (30) is positioned in a hollow portion of the low-pressure cylinder body (41), and is rotatably fitted into the first eccentric portion (27) of the shaft (25). In addition, the high-pressure piston (31) is positioned in a hollow portion of the high-pressure cylinder body (43), and is rotatably fitted into the second eccentric portion (28) of the shaft (25). A space defined by an inner circumferential surface of the low-pressure cylinder body (41), an outer circumferential surface of the low-pressure piston (30), an upper surface of the rear head (40), and a lower surface of the middle plate (42) serves as the low-pressure compression chamber (32). In addition, a space defined by an inner circumferential surface of the high-pressure cylinder body (43), an outer circumferential surface of the high-pressure piston (31), a lower surface of the front head (44), and an upper surface of the middle plate (42) serves as the high-pressure compression chamber (33).

In the low-pressure cylinder body (41), a low-pressure inlet port (45*a*) penetrating an outer circumferential surface and the inner circumferential surface of the low-pressure cylinder body (41) in the radial direction is formed. The low-pressure suction pipe (15) is connected to the low-pressure inlet port (45*a*).

In addition, in the high-pressure cylinder body (43), a high-pressure inlet port (45*b*) penetrating an outer circumferential surface and the inner circumferential surface of the high-pressure cylinder body (43) in the radial direction is formed. The high-pressure suction pipe (17) is connected to the high-pressure inlet port (45*b*).

In each of the low-pressure and high-pressure cylinder bodies (41, 43), a columnar bush hole (not shown in the figure) extending in a thickness direction of the cylinder body (41, 43) is formed. The bush hole is formed so as to open in the hollow portion of the cylinder body (41, 43) corresponding to part of a side circumferential surface of the bush hole.

A pair of swing bushes each having substantially a semi-circular cross section are rotatably engaged with the bush hole. The blade of the piston (30, 31) is slidably fitted between the pair of swing bushes. In such a state, the blade of the piston (30, 31) corresponding to the swing bushes divides the compression chamber (32, 33) into first and second chambers.

The rear head (40) includes a rear head body (50) and a lid (51). In the rear head body (50), a recessed portion (53) is formed so as to open to a lower side of the rear head body (50). The lid (51) is attached to the rear head (40) so as to close an opening of the recessed portion (53). Note that a space of the recessed portion (53), which is defined by the rear head body (50) and the lid (51) serves as a low-pressure discharge chamber.

In the rear head body (50), a low-pressure outlet port (54) penetrating the rear head body (50) in the radial direction is formed. One end of the low-pressure outlet port (54) opens in the low-pressure discharge chamber. The inlet pipe (8) of the discharge muffler (1) is connected to the other end of the low-pressure outlet port (54).

In addition, in the rear head body (50), a through-path (55) penetrating the rear head body (50) in a thickness direction thereof is formed. One end of the through-path (55) opens in the low-pressure discharge chamber (53), and the other end of the through-path (55) opens in the second chamber of the low-pressure compression chamber (32). An opening at the other end of the through-path (55) serves as an outlet port of the low-pressure compression chamber (32). Note that a low-pressure discharge reed valve (not shown in the figure) for opening/closing an opening of the through-path (55) in the low-pressure discharge chamber (53) is provided in the rear head body (50).

Although not shown in the figure, a high-pressure discharge path penetrating the front head (44) in a thickness direction thereof is formed in the front head (44). One end of the high-pressure discharge path opens in the second chamber of the high-pressure compression chamber (33), and the other end of the high-pressure discharge path opens in the casing (12). Note that, in an opening at the other end of the high-pressure discharge path, a high-pressure discharge reed valve (not shown in the figure) for opening/closing the opening is provided.

An outlet port of the first suction muffler (20) is connected to an end portion of the low-pressure suction pipe (15). An inlet port of the discharge muffler (1) is connected to an end portion of the inlet pipe (8). An outlet port of the second suction muffler (21) is connected to an end portion of the high-pressure suction pipe (17).

<Refrigerating Apparatus>

Figure 3:
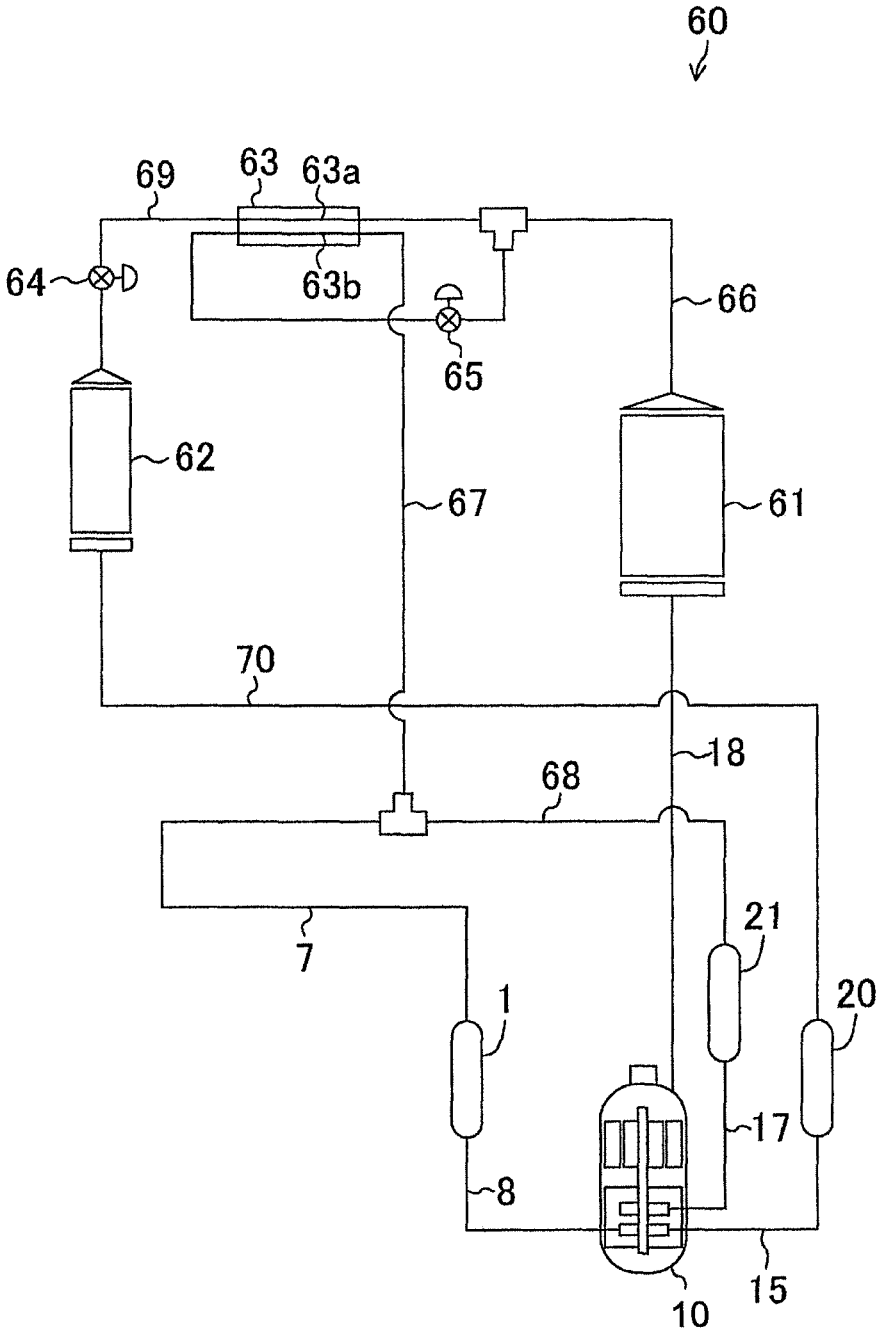
FIG. 3 is a refrigerant circuit diagram of a refrigerating apparatus of the embodiment of the present invention.

Next, the refrigerating apparatus will be described. As illustrated in FIG. 3, the refrigerating apparatus includes a refrigerant circuit (60) in which the two-stage compressor (10), the discharge muffler (1), and the first and second suction mufflers (20, 21) are connected together.

The refrigerant circuit (60) is configured to perform a vapor compression refrigeration cycle, and is filled with carbon dioxide which is refrigerant. Polyalkylene glycol (PAG) is used as refrigerating machine oil for lubricating each of the sliding portions of the two-stage compressor (10).

In addition to the two-stage compressor (10), the discharge muffler (1), and the first and second suction mufflers (20, 21), a radiator (61), an evaporator (62), a supercooling heat exchanger (63), an expansion valve (64), and a pressure reducing valve (65) are connected together in the refrigerant circuit (60).

Both of the radiator (61) and the evaporator (62) are cross-fin type fin-and-tube heat exchangers. An air blower (not shown in the figure) is provided near each of the radiator (61) and the evaporator (62). Both of the expansion valve (64) and the pressure reducing valve (65) are electronic expansion valves, a degree of opening of which is adjustable. The supercooling heat exchanger (63) includes a high-temperature path (63*a*) and a low-temperature path (63*b*), and is configured so that heat is exchanged between refrigerant passing through the high-temperature path (63*a*) and refrigerant passing through the low-temperature path (63*b*).

The discharge pipe (18) of the two-stage compressor (10) is connected to one end of the radiator (61). A first refrigerant pipe (66) extending from the other end of the radiator (61) is branched. One of the branched portions of the first refrigerant pipe (66) is connected to an inlet side of the low-temperature path (63*b*) of the supercooling heat exchanger (63) through the pressure reducing valve (65), and the other branched portion of the first refrigerant pipe (66) is connected to an inlet side of the high-temperature path (63*a*) of the supercooling heat exchanger (63). A second refrigerant pipe (67) extending from an outlet side of the low-temperature path (63*b*) of the supercooling heat exchanger (63) is connected to the middle of a third refrigerant pipe (68) connecting between the outlet pipe (7) of the discharge muffler (1) and the second suction muffler (21).

A fourth refrigerant pipe (69) extending from an outlet side of the high-temperature path (63*a*) of the supercooling heat exchanger (63) is connected to one end of the evaporator (62) through the expansion valve (64). A fifth refrigerant pipe (70) extending from the other end of the evaporator (62) is connected to an inlet port of the first suction muffler (20).

Operation

<Discharge Muffler>

When refrigerant gas discharged from the low-pressure compression chamber (32) of the two-stage compressor (10) and containing refrigerating machine oil flows into the muffler container (2) through the inlet pipe (8), noise of the refrigerant gas is canceled in the muffler container (2) while part of the refrigerating machine oil is separated from the refrigerant gas. The separated refrigerating machine oil is stored in the lower space (2*b*) of the muffler container (2), and the refrigerant gas from which the part of refrigerating machine oil is separated flows out from the muffler container (2) through the outlet path (7).

When a flow velocity of the refrigerant gas in the muffler container (2) is high, part of the stored refrigerating machine oil is blown up by the refrigerant gas, and is re-changed into mist. Then, the refrigerating machine oil flows out from the muffler container (2) through the outlet path (7) together with the refrigerant gas.

On the other hand, when the flow velocity of the refrigerant gas in the muffler container (2) is low, i.e., when it is likely to separate the refrigerating machine oil, and it is less likely to re-change the refrigerating machine oil into mist by blowing up the refrigerating machine oil by the refrigerant gas, an amount of the refrigerating machine oil stored in the lower space (2*b*) is increased, and therefore a surface level of the refrigerating machine oil rises. When the surface level of the refrigerating machine oil becomes higher than the inlet (7*c*) of the outlet pipe (7), the refrigerating machine oil flows into the outlet pipe (7) through the inlet (7*c*), and then flows out from the muffler container (2) through the outlet pipe (7).

Subsequently, when the refrigerating machine oil flows out from the muffler container (2), and the surface level of the refrigerating machine oil becomes lower than the inlet (7*c*) of the outlet pipe (7), the refrigerant gas in the muffler container (2) re-flows into the outlet pipe (7) through the inlet (7*c*), and then flows out from the muffler container (2) through the outlet pipe (7). In such a manner, the inlet (7*c*) of the outlet pipe (7), which opens in the lower space (2*b*) allows not only the refrigerant gas but also the refrigerating machine oil to flow out from the muffler container (2) through the outlet pipe (7).

<Two-Stage Compressor>

When the shaft (25) of the electrical motor (14) rotates, the low-pressure piston (30) eccentrically rotates in the low-pressure compression chamber (32), and the high-pressure piston (31) eccentrically rotates in the high-pressure compression chamber (33). By periodically changing a volume of the compression chamber (32, 33), refrigerant in the compression chamber (32, 33) can be compressed.

Since a state in which the high-pressure piston (31) eccentrically rotates in the high-pressure compression chamber (33) is the same as a state in which the low-pressure piston (30) eccentrically rotates in the low-pressure compression chamber (32), only the state in the low-pressure compression chamber (32) will be described, and the state in the high-pressure compression chamber (33) will not be repeated.

When the shaft (25) slightly rotates from a rotation angle of 0°, and a contact portion between the outer circumferential surface of the low-pressure piston (30) and an inner circumferential surface of the low-pressure compression chamber (32) passes through an opening of the low-pressure inlet port (45*a*), the low-pressure inlet port (45*a*) is in an open state, and refrigerant begins to be sucked into the first chamber through the low-pressure inlet port (45*a*). As the rotation angle of the shaft (25) increases, a volume of the first chamber gradually increases. The refrigerant is sucked into the first chamber in association with the increase in volume of the first chamber. Subsequently, when the rotation angle of the shaft (25) reaches 360°, the low-pressure inlet port (45*a*) is in a closed state, and the suction of the refrigerant into the first chamber is completed.

Meanwhile, unlike the first chamber, a volume of the second chamber gradually decreases in the second chamber as the rotation angle of the shaft (25) increases. Refrigerant in the second chamber is compressed in association with the decrease in volume of the second chamber. When a refrigerant pressure in the second chamber becomes equal to or higher than a predetermined pressure, the low-pressure discharge reed valve closing the through-path (55) opening on an outlet side of the second chamber is opened, and then the refrigerant in the second chamber is discharged. When the refrigerant is discharged, and the refrigerant pressure in the second chamber falls below the predetermined pressure, the low-pressure discharge reed valve is closed.

Subsequently, when the rotation angle of the shaft (25) reaches 360°, the discharge of the refrigerant from the second chamber is completed. In such a state, part of refrigerating machine oil supplied to each of the sliding portions of the compression mechanism (13) by the oil supply pump (57) of the shaft (25) is also discharged with the refrigerant. Such an operation is successively performed to compress the refrigerant in the low-pressure compression chamber (32).

<Refrigerating Apparatus>

Next, an operation of the refrigerating apparatus will be described.

High-pressure refrigerant compressed to a supercritical pressure in the high-pressure compression chamber (33) of the two-stage compressor (10) is discharged to the casing (12) of the two-stage compressor (10) together with refrigerating machine oil. The refrigerating machine oil is stored in the bottom portion (56) of the casing (12). The high-pressure refrigerant in the casing (12) flows out from the casing (12), and then flows into the radiator (61) through the discharge pipe (18).

The high-pressure refrigerant flowing into the radiator (61) dissipates heat to air sent by the air blower, and then flows out from the radiator (61). The high-pressure refrigerant flowing out from the radiator (61) is branched through the first refrigerant pipe (66). A pressure of part of the high-pressure refrigerant is reduced to a predetermined pressure by the pressure reducing valve (65), and such refrigerant is changed into intermediate-pressure refrigerant. Then, the intermediate-pressure refrigerant flows into the low-temperature path (63*b*) of the supercooling heat exchanger (63). Meanwhile, the remaining high-pressure refrigerant flows into the high-temperature path (63*a*) of the supercooling heat exchanger (63).

In the supercooling heat exchanger (63), heat is exchanged between the high-pressure refrigerant of the high-temperature path (63*a*) and the intermediate-pressure refrigerant of the low-temperature path (63*b*). The high-pressure refrigerant is cooled by dissipating heat to the intermediate-pressure refrigerant, and then flows out from the high-temperature path (63*a*). Meanwhile, the intermediate-pressure refrigerant absorbs heat from the high-pressure refrigerant, and then flows out from the low-temperature path (63*b*).

The intermediate-pressure refrigerant flowing out from the low-temperature path (63*b*) joins intermediate-pressure refrigerant flowing through the third refrigerant pipe (68) and containing refrigerating machine oil, through the second refrigerant pipe (67). Meanwhile, the high-pressure refrigerant flowing out from the high-temperature path (63*a*) flows into the expansion valve (64) through the fourth refrigerant pipe (69). A pressure of the high-pressure refrigerant is reduced to a predetermined pressure, and is changed into low-pressure two-phase refrigerant. Then, the low-pressure two-phase refrigerant flows out form the expansion valve (64). The low-pressure refrigerant flowing out from the expansion valve (64) flows into the evaporator (62). In the evaporator (62), the low-pressure refrigerant is evaporated by absorbing heat from air of the air blower arranged near the evaporator (62), and then is changed into low-pressure gas refrigerant. Then, the low-pressure gas refrigerant flows out from the evaporator (62).

The low-pressure gas refrigerant flowing out from the evaporator (62) is sucked into the low-pressure compression chamber (32) of the two-stage compressor (10) through the fifth refrigerant pipe (70), the first suction muffler (20), and the low-pressure suction pipe (15). Noise of the low-pressure gas refrigerant is canceled when such refrigerant passes through the first suction muffler (20).

The low-pressure gas refrigerant sucked into the low-pressure compression chamber (32) is compressed so as to have a predetermined pressure in the low-pressure compression chamber (32), and is changed into intermediate-pressure gas refrigerant. Then, the intermediate-pressure gas refrigerant is discharged from the low-pressure compression chamber (32). In such a state, refrigerating machine oil supplied to the sliding portions of the compression mechanism (13) to lubricate the sliding portions is also discharged with the intermediate-pressure gas refrigerant. The intermediate-pressure gas refrigerant discharged from the low-pressure compression chamber (32) and containing the refrigerating machine oil flows into the discharge muffler (1) through the inlet pipe (8).

As described above, in the discharge muffler (1), noise of the intermediate-pressure gas refrigerant is canceled in the muffler container (2) while part of the refrigerating machine oil is separated from the intermediate-pressure gas refrigerant. Then, the intermediate-pressure gas refrigerant, the noise of which is canceled and the refrigerating machine oil flow into the third refrigerant pipe (68) through the outlet pipe (7) of the discharge muffler (1).

As described above, the intermediate-pressure gas refrigerant flowing through the third refrigerant pipe (68) and containing the refrigerating machine oil joins the intermediate-pressure refrigerant flowing out from the low-temperature path (63*b*) of the supercooling heat exchanger (63) and flowing through the second refrigerant pipe (67), in the middle of the third refrigerant pipe (68). The joined intermediate-pressure gas refrigerant is sucked into the high-pressure compression chamber (33) of the two-stage compressor (10) through the second suction muffler (21) and the high-pressure suction pipe (17). In such a state, noise of the intermediate-pressure gas refrigerant is canceled when such refrigerant passes through the second suction muffler (21).

The intermediate-pressure gas refrigerant sucked into the high-pressure compression chamber (33) and containing the refrigerating machine oil is re-compressed to the supercritical pressure in the high-pressure compression chamber (33), and is changed into high-pressure refrigerant. Then, the high-pressure refrigerant is discharged to the casing (12) of the two-stage compressor (10) together with the refrigerating machine oil supplied to the sliding portions of the compression mechanism (13) to lubricate the sliding portions.

After the refrigerating machine oil is stored in the bottom portion (56) of the two-stage compressor (10), the refrigerating machine oil is drawn by the oil supply pump (57) of the shaft (25), and then is supplied to each of the sliding portions of the compression mechanism (13). Meanwhile, the high-pressure refrigerant re-flows into the radiator (61) from the casing (12) through the discharge pipe (18). As in the foregoing, the operation of the refrigerating apparatus is performed.

Advantages of Embodiment

According to the present embodiment, the inlet (7*c*) of the outlet pipe (7) opens in the lower space (2*b*), and therefore not only refrigerant gas but also refrigerating machine oil accumulated in the lower space (2*b*) can be discharged through the outlet pipe (7). Unlike the prior art, the refrigerating machine oil can be discharged to outside the muffler container (2) without using an oil return pipe. As a result, it is less likely that the refrigerating machine oil is accumulated in the discharge muffler (1). In addition, the refrigerating machine oil flowing out from the muffler container (2) can be returned to the casing (12) of the two-stage compressor (10) through the low-pressure compression chamber (32).

According to the present embodiment, the inlet (7*c*) of the outlet pipe (7) and the outlet (8*a*) of the inlet pipe (8) are arranged in the positions which do not face each other. This reduces quick flowing of refrigerant gas discharged through the outlet (8*a*) of the inlet pipe (8) and containing refrigerating machine oil into inlet (7*c*) of the outlet pip (7). Consequently, a function to cancel noise of refrigerant gas passing through the discharge muffler (1) and containing refrigerating machine oil and a function to separate the refrigerating machine oil from the refrigerant gas are not degraded.

According to the present embodiment, the inlet (7*c*) of the outlet pipe (7) is arranged lower than the outlet (8*a*) of the inlet pipe (8). Thus, it is less likely that the outlet (8*a*) of the inlet pipe (8) is immersed in refrigerating machine oil accumulated in the lower space (2*b*), and refrigerant gas containing the refrigerating machine oil can smoothly flow into the muffler container (2) through the outlet (8*a*) of the inlet pipe (8).

Other Embodiment

The foregoing embodiment may have the following configurations.

Figure 4:
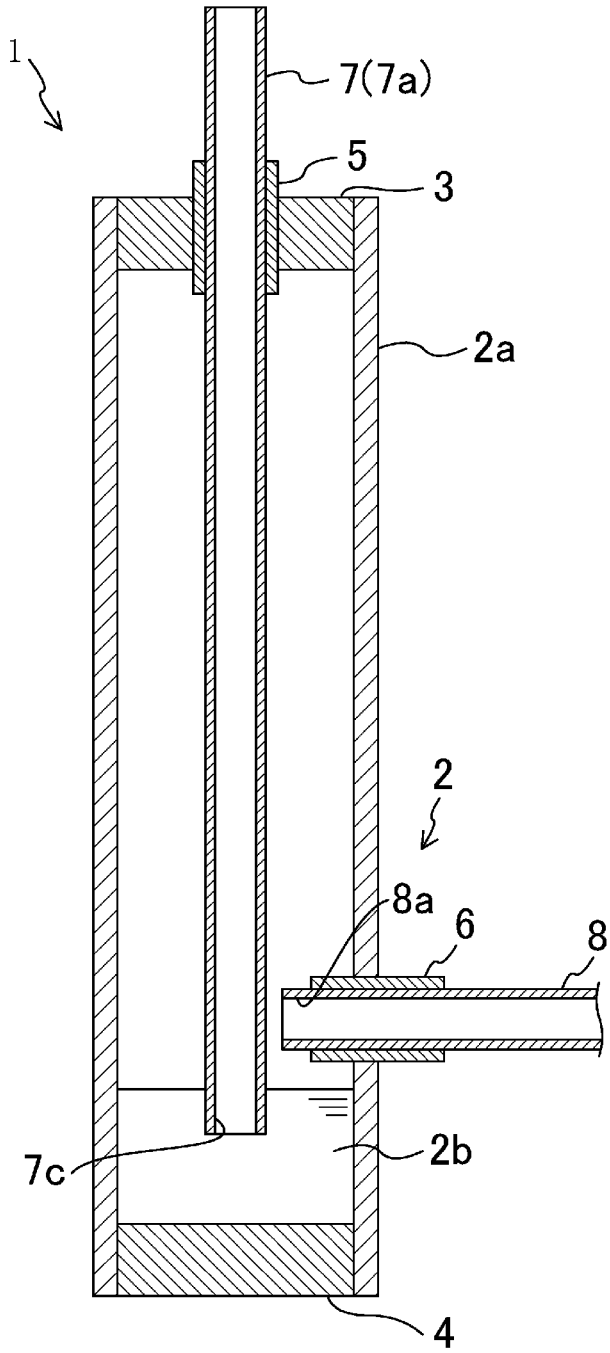
FIG. 4 is a longitudinal sectional view of a discharge muffler of another embodiment.

In the foregoing embodiment, the inlet pipe (8) is the elbow pipe curved 90 degrees, but the present invention is not limited to such a configuration. As illustrated in FIG. 4, the inlet pipe (8) may be a straight pipe. In such a case, a through-hole may be formed in a lower portion of the body (2*a*) of the muffler container (2), and the inlet pipe (8) which is the straight pipe is fixed with the inlet pipe (8) being inserted to the through-hole. The outlet end (8*a*) of the inlet pipe (8) and the inlet end (7*c*) of the outlet pipe (7) can be in the positions which do not face each other without curving the outlet pipe (7).

In the foregoing embodiment, the circular piston (30, 31) is accommodated in the circular compression chamber (32, 33) of the compression mechanism (13), but the present invention is not limited to such a configuration. For example, a configuration may be employed, in which an annular compression chamber is provided, and an annular piston is accommodated so as to divide the annular compression chamber into inner and outer compression chambers.

In the foregoing embodiment, the discharge muffler is connected to an outlet side of the low-pressure compression chamber of the two-stage compressor, but the present invention is not limited to such a configuration. The discharge muffler may be connected to an outlet side of a single-stage compressor.

The foregoing embodiments have been set forth merely for purposes of preferred examples in nature, and are not intended to limit the scope, applications, and use of the invention.

INDUSTRIAL APPLICABILITY

As described above, the present invention is useful for the discharge muffler for reducing noise of refrigerant discharged from the compressor, and the two-stage compressor including the discharge muffler.

DESCRIPTION OF REFERENCE CHARACTERS

1 Discharge Muffler
2 Muffler Container
3 Upper Closing Plate
4 Lower Closing Plate
7 Outlet Pipe (Outlet Path)
8 Inlet Pipe (Inlet Path)
10 Two-Stage Compressor
20 First Suction Muffler
21 Second Suction Muffler
60 Refrigerant Circuit

The invention claimed is:

1. A discharge muffler, comprising:

a muffler container;

an inlet path through which refrigerant gas discharged from a compressor and containing refrigerating machine oil flows into the muffler container; and an outlet path through which the refrigerant gas flows out from the muffler container, wherein, in the muffler container, the refrigerating machine oil is separated from the refrigerant gas containing the refrigerating machine oil, and the refrigerating machine oil separated from the refrigerant gas is stored in a lower space of the muffler container, an inlet of the outlet path opens in the lower space, said outlet path is configured to discharge the refrigerant gas and the refrigerating machine oil stored in the lower space of the muffler container, the inlet path is provided at a lower most section within a lower most surface of the muffler container, and the outlet path is provided at an upper surface of the muffler container, and the inlet of the outlet path is located so as to bring about a state in which the refrigerating machine oil flows into the outlet path when a surface level of the refrigerating machine oil stored in the lower space of the muffler container becomes higher than the inlet of the outlet path, and the refrigerant gas flows into the outlet path when the surface level of the refrigerating machine oil stored in the lower space of the muffler container becomes lower than the inlet of the outlet path.

2. The discharge muffler of claim 1, wherein the inlet of the outlet path and an outlet of the inlet path are arranged in positions which do not face each other.

3. The discharge muffler of claim 1 or 2, wherein the inlet of the outlet path is arranged lower than the outlet of the outlet path.

4. A two-stage compressor including a compression mechanism in which a low-pressure compression chamber and a high-pressure compression chamber are formed, and a casing in which the compression mechanism is accommodated, an outlet port of the high-pressure compression chamber opening in the casing and refrigerant compressed in the low-pressure compression chamber being further compressed in the high-pressure compression chamber, the two-stage compressor, comprising:

the discharge muffler of claim 1 or 2, wherein an inlet of the inlet path of the discharge muffler is connected to an outlet port of the low-pressure compression chamber, and an outlet of the outlet path of the discharge muffler is connected to an inlet port of the high-pressure compression chamber.

* * * * *